United States Patent [19]

Patrick

[11] Patent Number: 5,056,322

[45] Date of Patent: Oct. 15, 1991

[54] HALF CRESCENT SHAPED ICE PIECE MAKER

[75] Inventor: Kenneth H. Patrick, Rainbow City, Ala.

[73] Assignee: Mid-South Industries, Inc., Rainbow City, Ala.

[21] Appl. No.: 637,617

[22] Filed: Jan. 4, 1991

[51] Int. Cl.[5] ..... F25C 5/08

[52] U.S. Cl. ..... 62/73; 62/351

[58] Field of Search ..... 62/73, 351, 71, 353

[56] References Cited

U.S. PATENT DOCUMENTS

| | | | |
|---|---|---|---|
| 4,706,465 | 11/1987 | Searl | 62/353 X |
| 4,896,513 | 1/1990 | Troscinski | 62/351 |
| 4,923,494 | 5/1990 | Karlovits | 62/351 X |

*Primary Examiner*—William E. Tapolcai

*Attorney, Agent, or Firm*—Donald W. Phillion, Sr.

[57] ABSTRACT

A half crescent shaped ice piece maker comprising a freezing tray (100) having an inner surface arcuately shaped about a longitudinal radial axis and divided into crescent shaped water fillable cavities (112) in which the ice pieces are formed, and an ejector assembly (102) for rotatively moving the ice pieces out of the cavities (122) comprising a rotatable shaft (106) supported in bearings with its axis coincident with the radial axis, and with ejector assembly (102) further comprising a row of primary flexible, spring-like ejector elements (114) lying in a common plane and each secured at a first end to the shaft (106) and having its second end extend into one of the crescent shaped cavities (122) to divide the cavity (122) into rotatively leading and lagging partial crescent shaped cavities while water is injected and frozen therein and before the ejector assembly (102) is rotated to form leading and lagging rows of partial crescent ice pieces with ice bridges (152) around the edges of the ejector elements (114) between the leading and lagging partial crescent ice pieces (130) and (132) of each full crescent shaped ice piece, and a prime mover for rotating the ejector assembly. A fixed position ice stripper assembly (104) is positioned in the path of the ice pieces being rotated by the ejector assembly (102) to stop the rotation of the ice pieces and bend back the row of flexible spring-like ejector elements to create a potential force therein and to break the ice bridge between the leading and lagging half crescent ice pieces and enable the flexible, spring-like ejector elements to spring forward to eject the leading row of half crescent ice pieces from the freezing tray. A second row of ejector elements functions to eject the lagging row of partial crescent ice pieces from the tray.

12 Claims, 7 Drawing Sheets

ICE BRIDGE 152 BROKEN
INTO COLLECTION BIN
154
114c
125
108
116c
106
120b
104c
100
104k
122c
126

ICE PIECE
104k
104c
114c
125
108
116c
106
120b
126
100
122c 104c
114c
125
108
116c
120b
26
122c
100
130
COLLECTION BIN 154

104k
132
114c
116c
108
100

104c
132
114c
116c
125
108
100

104k
104c
114c
132'
125
116c
130'
108

FLEXED EJECTOR ELEMENT 114c
FLEXED
COLLECTION BIN
106
114c
116c
104b
104k
115
121
130
132
135
154

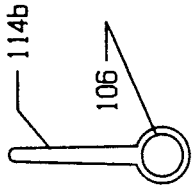
Fig. 25
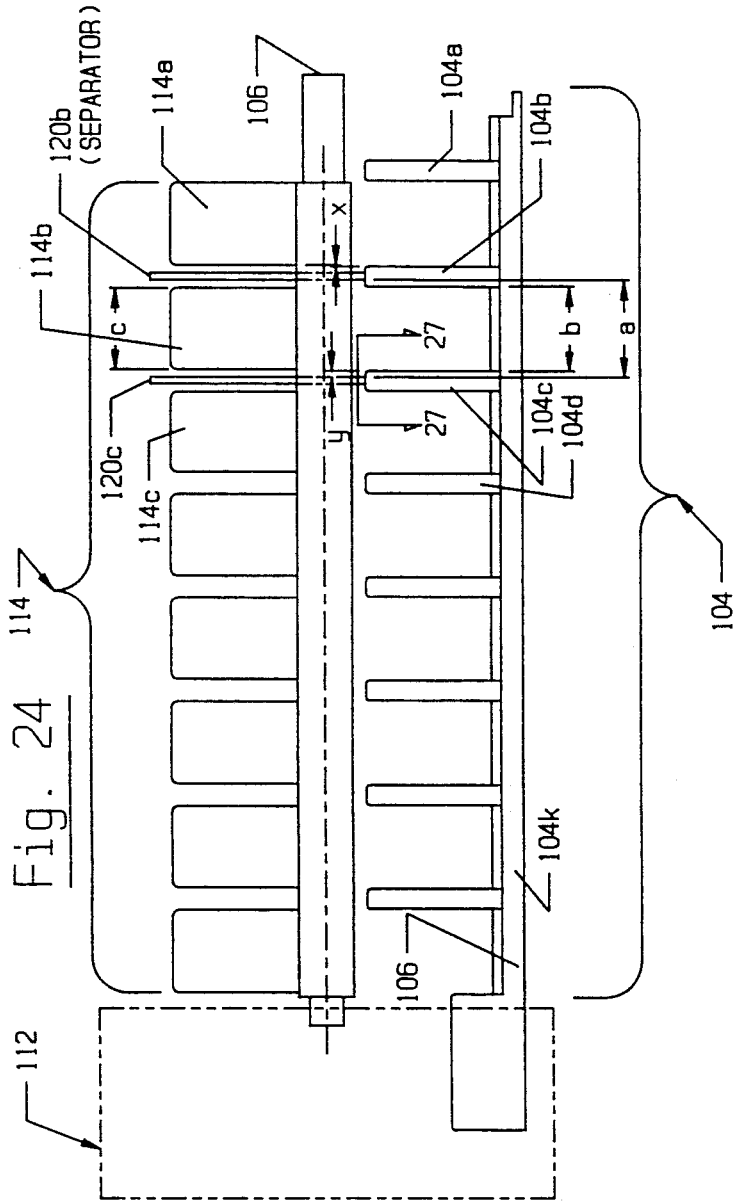
Fig. 24
Fig. 24a
LEGEND
a = DISTANCE BETWEEN EDGES OF ADJACENT SEPARATORS AND WIDTH OF ICE PIECE
b = DISTANCE BETWEEN ADJACENT STRIPPER ELEMENTS
c = WIDTH OF EJECTOR ELEMENT
x = 0.060"
y = 0.120"
a - c = 0.120" = 2x
b - c = 0.240" = 2y
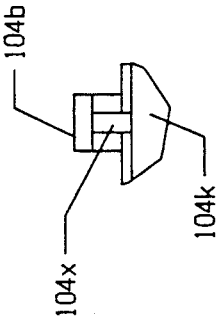
Fig. 27
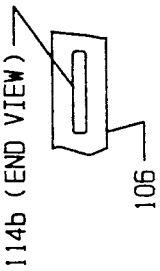
Fig. 26

HALF CRESCENT SHAPED ICE PIECE MAKER

I. BACKGROUND OF THE INVENTION

This invention relates generally to ice piece makers for refrigerators and the like and more particularly to ice piece makers that make half crescent shaped ice pieces, and the method for making such half crescent shaped pieces.

Perhaps the most prevalent form of ice piece makers currently employed in home refrigerators and freezers make full crescent shaped ice pieces with crescent shaped parallel sides and a rectangularly shaped cross sectional profile viewed in a plane normal to the parallel sides, and further having a flat top surface.

The full crescent shaped ice pieces are easily formed and removed from ice piece makers and required simpler and less expensive ice piece making mechanisms than do makers of ice pieces of different configuration—i.e. cubes, cylinders, etc. Because of this feature, the full crescent shape is preferred by most manufactures of domestic ice piece makers. It remains, however, that, although adequate for many applications for ice pieces, the full crescent shaped presents difficulties in use in the home particularly when used for cooling beverages in beverage glasses but also in storage, removal and handling of the ice pieces in preparation of beverages and other uses for ice pieces.

Full crescent shaped ice pieces are somewhat difficult to insert in glasses used in the home for holding most beverages. More specifically, the length of the top surface of the crescent shaped ice piece coupled with the fact that the ice pieces are usually found in the collection bin joined together in groups of three or four or more up to the length of the forming tray, make it difficult or impossible to fit such large groups of ice pieces into a glass. It is often not possible to fit more than a group of two joined ice pieces into a glass at a time if the glass opening is small. Even if the glass opening is large, the shape of a group of several connected full crescent shaped ice pieces will lie at an angle in the glass and seriously hinder adding more crescent shaped ice pieces into the glass.

These situations usually require breaking up the groups of ice pieces in the collection bin before removing them for use and many times require further manual breaking of the individual full crescent shaped ice pieces into smaller pieces using an ice cracker or similar device. This procedure is time consuming, frustrating, and usually results in ice chips being scattered around the work area, necessitating cleanup after preparation of a drink.

Furthermore, it is difficult to remove the crescent shaped ice pieces from the collection bin with a cup or a scoop, for example, because of the size and awkward shape of the ice pieces. Even when the crescent shaped ice pieces are successfully scooped out of the collection bin with a cup or scoop, some of them frequently slip off the scoop and drop on the floor where they slide in all directions. Free ice pieces on the vinyl floor of a kitchen present a dangerous condition since stepping on an ice piece is probably about as risky as stepping on a wet bar of soap on a tiled bathroom floor.

Other problems presented by prior art half crescent ice piece makers are as follows:

1. All of the leading and lagging half crescent shaped ice pieces of full crescent shaped ice pieces do not break apart as they are being ejected from the tray due to various reasons such as the temperature of the leading and lagging half crescent shaped ice pieces forming the full crescent shaped ice pieces.

2. Moving half or full crescent shaped ice pieces out of the freezing tray enhances the risk, with most prior art devices, of an ice piece accidentally falling back into the tray before it is ejected from the tray, thereby increasing the risk of faulty operation of the ice maker even to the point of stalling the rotation of the shaft.

Clearly, the formation of smaller, lighter, and less awkwardly shaped ice pieces, such as half crescent shaped ice pieces, would mark a definite improvement in the art of forming ice pieces for use in home refrigerators and also in commercial applications such as the manufacturing of ice pieces to be sold in bulk by stores, service stations, etc.

Prior art half crescent shaped ice piece maker are disclosed in U.S. Pat. No. 4,896,153 issued 1/30/90 to Trocinski and entitled "Making Ice In A Refrigerator" and in U.S. Pat. No. 4,923,494 issued 5/8/90 to Karlovits and entitled "Making Ice A Refrigerator".

In both Trocinski and Karlovits there is shown an elongated freezing tray with an arcuately shaped inner surface divided into crescent shaped cavities by equal spaced partitions to form a plurality of crescent shaped cavities. A rotatable shaft is secured at both ends in bearings with its axis coincident with the axis of the arcuately shaped inner surface of said tray and further having three rows of ejector elements secured to and extending radially outward from said rotatable shaft. Each of these three rows of ejector elements lies along a separate common plane parallel to the axis of said rotatable shaft and spaced 120° from the adjacent rows of ejector elements.

Further in both Trocinski and Karlovits the ejector elements of one row of ejector elements, identified herein as the primary ejector elements, each extends perpendicularly down into the center of a water filled crescent shaped cavity 14 to divide the crescent shaped volume of water therein into two half crescent shaped ice pieces.

One of the problems presented by prior art ice piece makers, and particular half crescent ice piece makers, is due to the ice half crescent ice pieces becoming solidly frozen to the ejector element (the primary ejector element) which lies between the leading and lagging half crescent ice pieces. This ice bond between the leading and lagging half crescent ice pieces is sometimes sufficiently strong to resist being broken loose from the primary ejector elements when the leading half crescent ice piece impacts the ice piece stripper elements with the result that the rotating shaft will stall and must be freed by human help.

In half crescent shaped ice pieces there is another ice bond, identified herein as an ice bridge which exists around the primary ejector elements and connects the leading half crescent ice piece to the lagging half crescent ice piece of each full crescent shaped ice piece. The above-described ice bridge must also be broken when the leading half crescent ice piece impact the ice stripper elements in order to separate the leading half crescent ice piece from the lagging half ice piece of each full crescent ice piece.

In both Trocinski and Karlovits all of the ejector elements are rigid and require a substantial force, represented by the motor rotating the shaft to which the ejector elements are rigidly attached, in order to break loose the leading half crescent shaped ice piece from the primary ejector element to which it is frozen and also to break the ice bridge connecting the leading and lagging half crescent ice pieces.

It would mark a definite improvement in the art to provide an improved half crescent ice piece maker which efficiently and with a minimum of force ejects the leading and lagging rows of half crescent shaped ice pieces from the freezing tray as quickly as possible to minimize the dripping of water into the freezing tray, to minimize the risk of a leading half crescent ice piece from accidentally dropping into the freezing tray, and most importantly to virtually ensure the breaking apart of the leading and lagging rows of half crescent shaped ice pieces before the ejection thereof from the freezing tray occurs.

It is submitted that the simultaneous breaking apart of large common areas of the leading and lagging half crescent ice pieces of prior art structures require a larger motor than is required by the structure of the present invention with attendant problems of undesirable heat generation and dissipation thereof. Furthermore, the cost of manufacturing three rows of ejector elements rather than only two rows of ejector elements is greater.

II. OBJECTS AND BRIEF STATEMENT OF THE INVENTION

A primary object of the present invention is to more efficiently and with greater reliability make half crescent shaped ice pieces than is possible with the known prior art while maintaining the relative mechanical simplicity and other advantages of the prior half crescent ice piece makers.

A second object of the invention is to provide the user, such as the homeowner, with an improved and more reliable partial crescent shaped ice piece maker which makes ice pieces which are sufficiently small to take, by hand, scoop or tongs, from the ice piece collection bin, and drop them into a glass container commonly used to hold water, tea, cola, or mixed drinks as used by homeowners and their families and guests.

Still another object of the invention is to provide a half piece ice maker in which the half crescent ice pieces will be more easily released from the ejector elements to which they are initially frozen and which will therefore be delivered with greater regularity than heretofore known to a collection bin from whence the homeowner can easily retrieve them.

In one preferred embodiment of the invention there is provided an ice piece maker comprising a freezing tray having an inner surface arcuately shaped about a longitudinal radial axis and divided into crescent shaped water fillable cavities in which said ice pieces are formed, and an ejector assembly for rotatively moving the ice pieces out of the cavities comprising a rotatable shaft with its axis coincident with the radial axis, and with the ejector assembly further comprising a row of rotatable, primary flexible, spring-like ejector elements lying in a common plane and each secured at a first end to the shaft and having its second end extend into one of the crescent shaped cavities to divide the cavity into rotatively leading and lagging partial crescent shaped cavities while water is being injected and frozen therein and, before the ejector assembly is rotated, to form leading and lagging rows of half or partial crescent ice pieces with ice bridges fromed around the edges of the flexible, spring like ejector elements between the leading and lagging half crescent ice pieces of each full crescent shaped ice pieces, and a rotatable shaft for rotating the ejector assembly.

A non-rotatable ice stripper assembly is positioned in the path of the ice pieces being rotated by the ejector assembly to stop the rotation of only the ice pieces and to bend back the row of flexible spring-like ejector elements to created a potential force therein of a magnitude which will break the ice bridge between the leading and lagging half crescent ice pieces of the full crescent shaped ice pieces and enable the flexible, spring-like ejector elements to then spring forward and eject the leading row of half crescent ice pieces from the freezing tray. A second row of ejector elements is provided for ejecting the lagging row of ice pieces from the freezer tray.

A feature of the invention is to employ the basic structure used to form full crescent shaped ice pieces to also form the present half crescent shaped ice piece maker utilizing an improved flexible, spring-like row of leading or primary ejector elements to facilitate the breaking apart of the leading and lagging rows of half crescent shaped ice pieces and the ejection of the leading row of half crescent shaped ice pieces from the freezing tray.

A second feature of the invention employs a row of flexible, spring-like primary ejector elements separating the leading and lagging rows of half crescent shaped ice pieces and which are flexed back against the direction of rotation of the rotatable shaft when the leading row of half crescent shaped ice pieces impacts against the non-rotatable stripper elements to break loose both the leading and lagging rows of half crescent ice pieces from the primary ejector element and also to break the ice bridge between the leading and lagging rows of half crescent shaped ice pieces, thereby enabling the flexible, spring-like ejector element to spring forward and impel the leading row of half crescent ice pieces out of the freezing tray.

An optional feature of the invention is to provide each of the flexible, spring-like primary ejector elements with a small protuberance formed on the surface thereof facing the lagging row of ejector elements to temporarily prevent the movement of the lagging row of half crescent shaped ice pieces upwardly or downwardly on the flexible, spring-like ejector elements before and after the flexible, spring-like ejector elements have been flexed backwards a sufficient amount to break apart the leading and lagging rows of half crescent ice pieces.

III. BRIEF DESCRIPTION OF THE DRAWINGS

The above and other objects and features of the invention will be more fully understood from the following detailed description thereof when read in conjunction with the drawings in which.

Figures 1, 2, 3, 4:
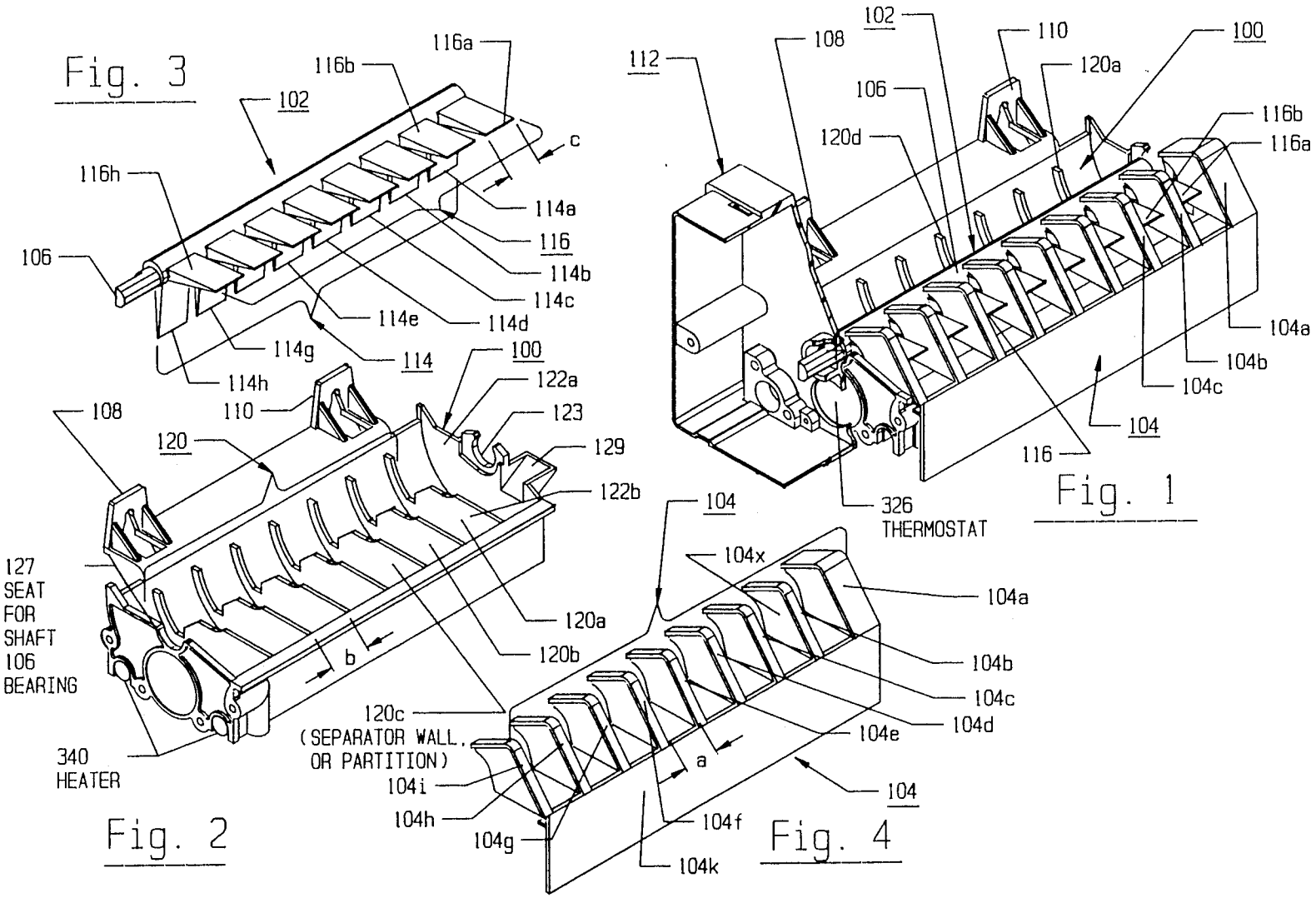
FIG. 1 is a partially broken away isometric view of the invention.
FIG. 2 is an isometric view of the arcuately shaped freezer tray.
FIG. 3 is an isometric view of the ice piece ejector element assembly.
Figure 3A:
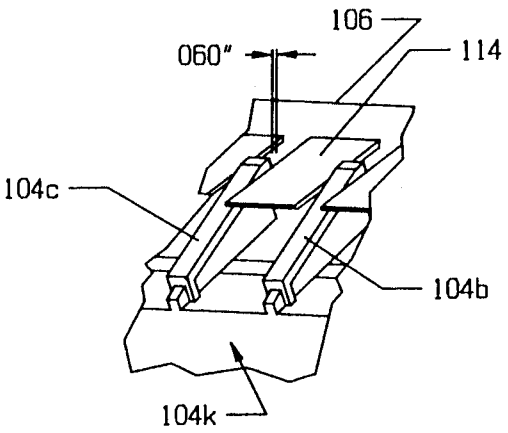
Figure 3B:
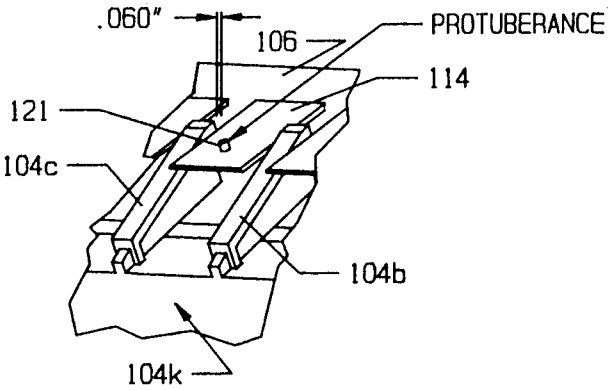
Figure 5A:
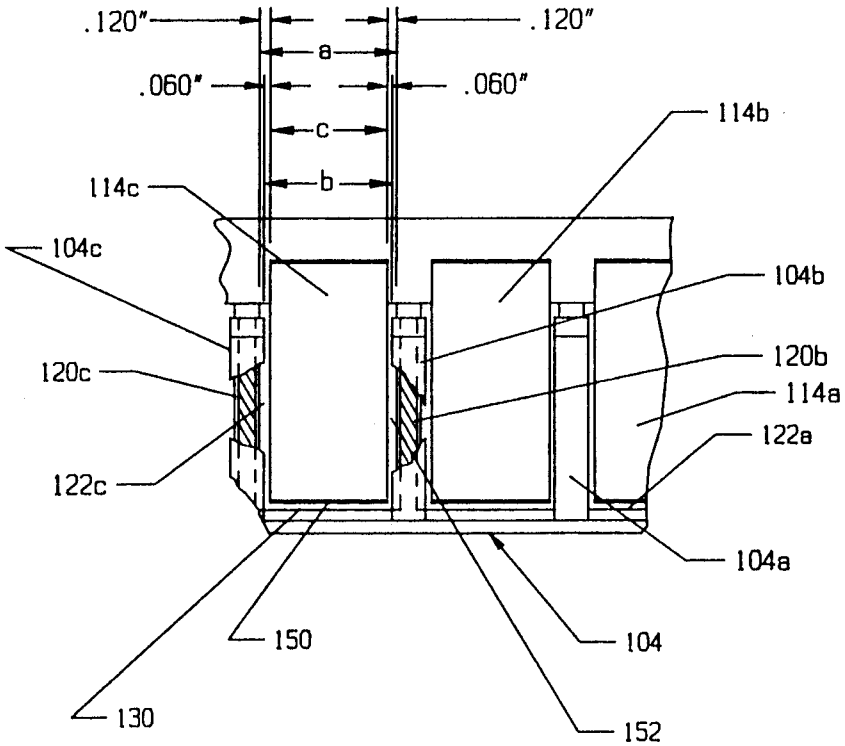
Figures 5, 6, 7, 8, 9:
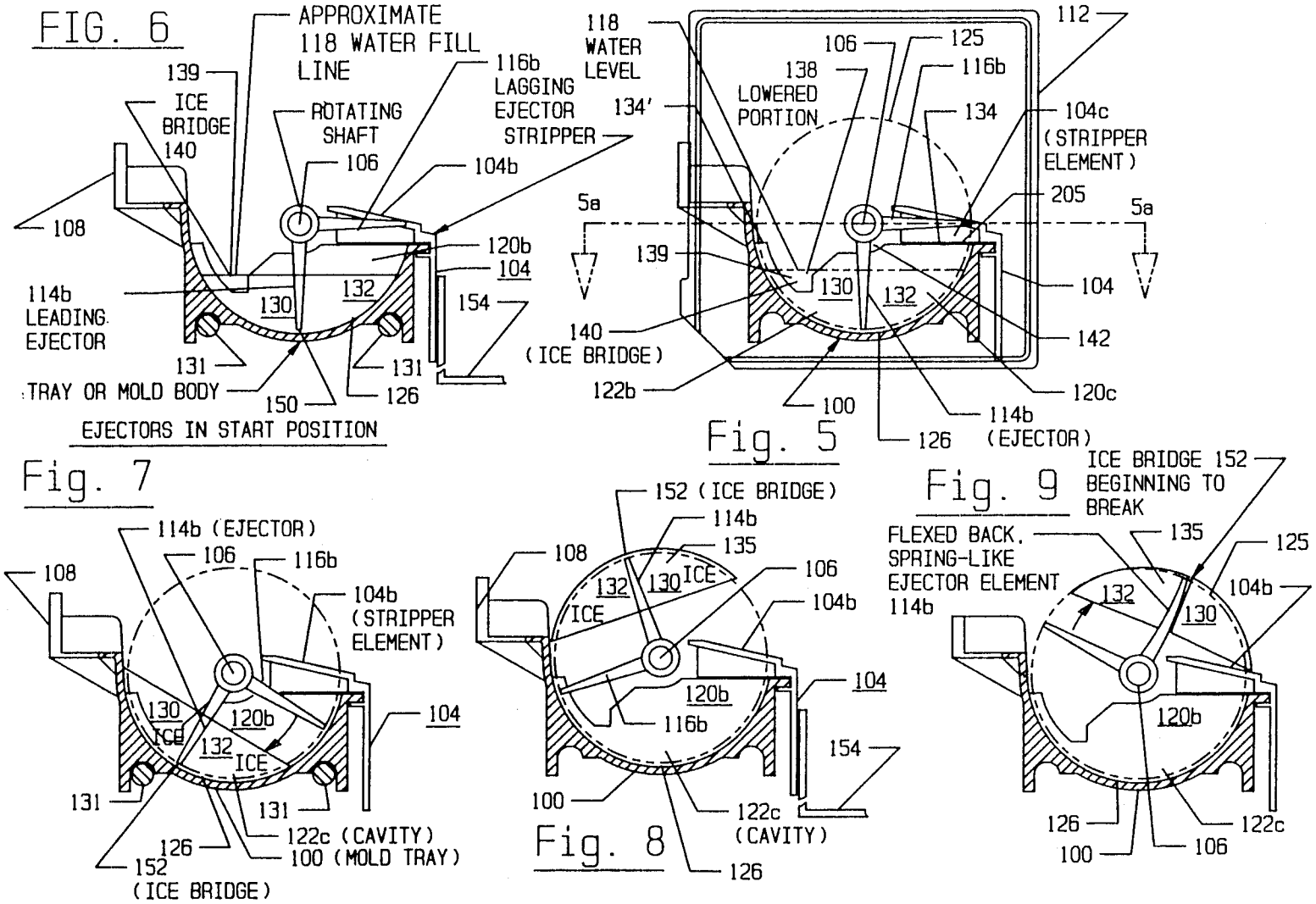

FIG. 3*a* is an enlarged isometric view of one form of the flexible, spring-like ejector elements with a stripper element on either side thereof;

FIG. 3*b* is an isometric view of another form of the flexible, spring-like ejector elements with a stripper element on either side thereon and with a protuberance on the side thereof facing the lagging row of half crescent shaped ice pieces;

FIG. 4 is an isometric view of the ice piece stripper assembly;

FIG. 5 is a cross-sectional view of the half crescent shaped ice piece maker including the casing for the controls and the motor drive, the ice piece forming tray, leading and lagging ice piece ejector elements with the leading ejector element being the flexible, spring-like ejector element, an ice piece separator, and an ice piece stripper element, with the single leading and lagging ice piece ejector elements and the single ice piece stripper being representative of only one of the entire ice piece ejector assembly and the ice piece stripper element assembly;

FIG. 5*a* is a partial cross-sectional view of FIG. 5 to illustrate more clearly the spatial relation between the leading flexible, spring-like ejector elements, the separators, the rotating shaft, the ice pieces, and the ice bridge formed between adjacent full crescent shaped ice pieces;

FIGS. 6–15 show the sequence of operation of one preferred mode of the invention for the formation of half crescent shaped ice pieces through successive stages of rotation of the ejector elements until the leading half of the crescent shaped ice pieces are stripped off by the ice piece stripper assembly and dropped into the collection bin and then the second or lagging half of the crescent shaped ice pieces are stripped off by the ice piece stripper assembly and dropped into the ice piece collection bin;

FIGS. 16–23 show the sequence of operation of another mode of the invention for the formation of half crescent shaped ice pieces through successive stages of rotation of the ejector elements until the leading half of the crescent shaped ice pieces are stripped off by the ice piece stripper assembly and dropped into the collection bin and then the second or lagging half of the crescent shaped ice pieces are stripped off by the ice piece stripper assembly and dropped into the ice piece collection bin;

FIGS. 24 and 24*a* show a top view of the tray, the leading set of flexible, spring-like ejector elements, after they have rotated about 90 degrees, the stripper elements, and the dimensional relationship between the various elements to cause the stripper elements to strip the ice pieces from the ejector elements while at the same time allowing the ejector elements to pass between adjacent stripper elements;

FIG. 25 is a side view of one of the flexible, spring-like ejector elements;

FIG. 26 is an end view of one of the ejector elements;

FIG. 27 is a front view of one of the stripper elements; and

Figure 28:
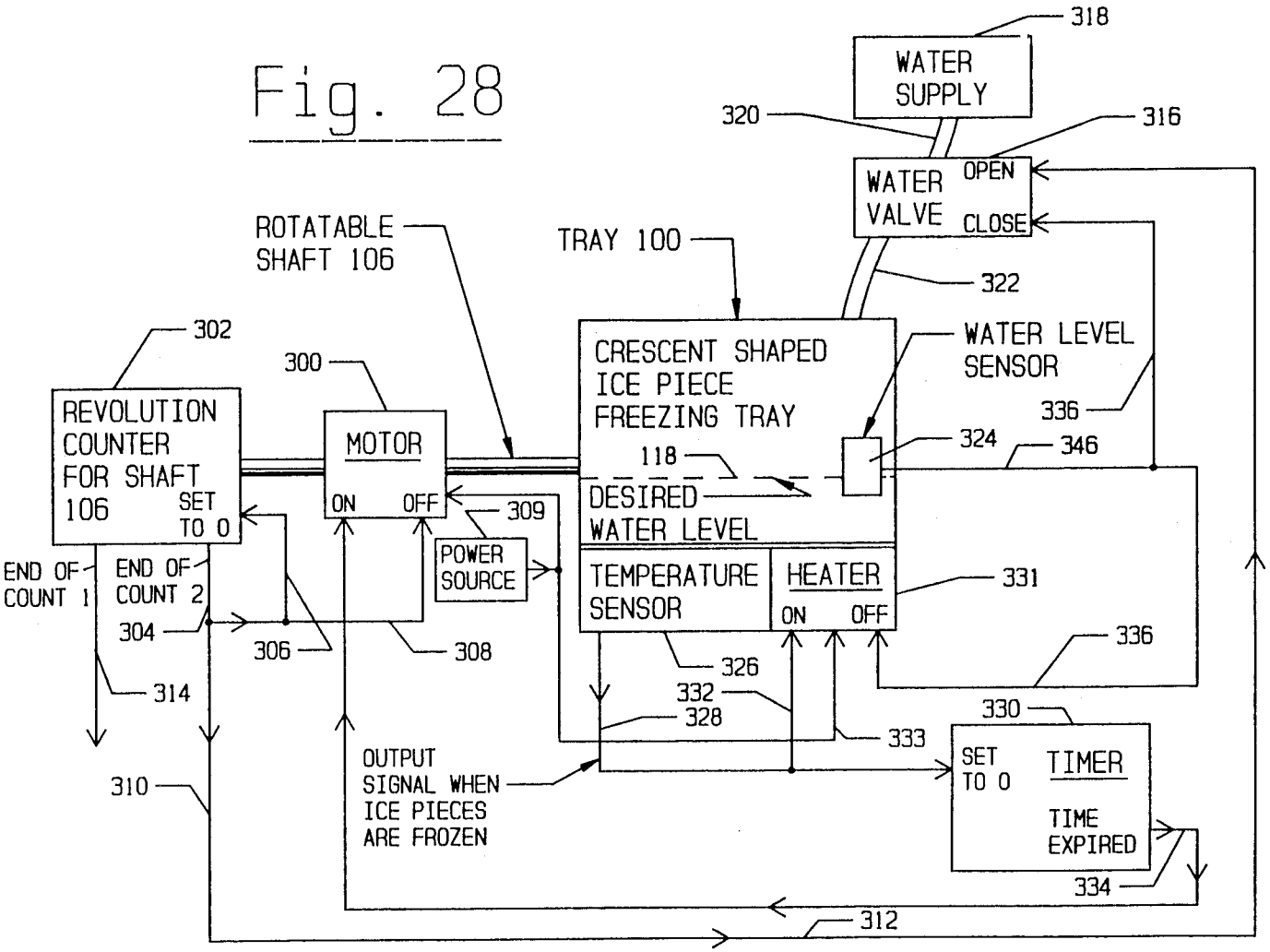

FIG. 28 shows a functional diagram of the control logic which controls the sequence and order of steps required to manufacture half crescent shaped ice pieces.

In order to facilitate the reading of this specification the following outline of the subject matter therein is set forth below:

I—BACKGROUND OF THE INVENTION
II—OBJECTS AND BRIEF STATEMENT OF THE INVENTION
III—BRIEF DESCRIPTION OF THE DRAWINGS
IV—DESCRIPTION OF THE BASIC FORM OF THE INVENTION (FIGS. 1–5)
V—DESCRIPTION OF THE OPERATION OF THE BASIC FORM OF THE INVENTION (FIGS. 6–15)
VI—DESCRIPTION OF THE OPERATION OF AN ALTERNATIVE FORM OF THE INVENTION (FIGS. 16–23)
VII—DETAILED DISCUSSION OF RELATIONS OF CAVITY WIDTH, EJECTOR ELEMENT WIDTH, AND WIDTH BETWEEN STRIPPER ELEMENTS REQUIRED TO EJECT HALF CRESCENT SHAPED ICE PIECES (FIGS. 24–28).
VIII—DESCRIPTION OF THE FUNCTIONAL CONTROL LOGIC OF THE INVENTION

IV. DESCRIPTION OF THE BASIC FORM OF THE INVENTION (FIGS. 1–5)

In describing the invention a general description of the partial, broken away isometric view of FIG. 1 will first be described to familiarize the reader with the general structural and operational relationship of the three main parts of the invention including the arcuately shaped, elongated and compartmentalized tray 100 of FIG. 2, the ejector elements assembly 114 and 116 of FIG. 3, and the stripper assembly 104 of FIG. 4.

Next, each of three above-mentioned main parts of the invention will be described individually followed by a detailed description of the flexible, spring-like leading primary ejector elements 114 and finally by the operation of both modes of the invention, as shown in FIGS. 6–23.

It should be noted that throughout all of the figures similar parts are identified by the same reference character. It is to be also noted that the total ejector assembly 102 of FIG. 3 has pluralities of elements such as the two groups of ejector elements 114 and 116 which are identified individually by reference characters 114*a*, 114*b* - - -114*h*, and 116*a*, 116*b* - - - 116*h*. Similarly, the pluralities of separators 120 and cavities 122 shown in various figures and shown collectively in FIG. 2 are identified individually by reference characters 120*a*, 120*b*, 120*c* - - - 120*h*, and 122*a*, 122*b*, 122*c* - - - 122*h*. The stripper assembly 104 of FIG. 4 also has its individual stripper elements identified by reference characters 104*a*, 104*b*, 104*c* - - - 104*i*.

Figures 10, 11, 12, 13, 14, 15:
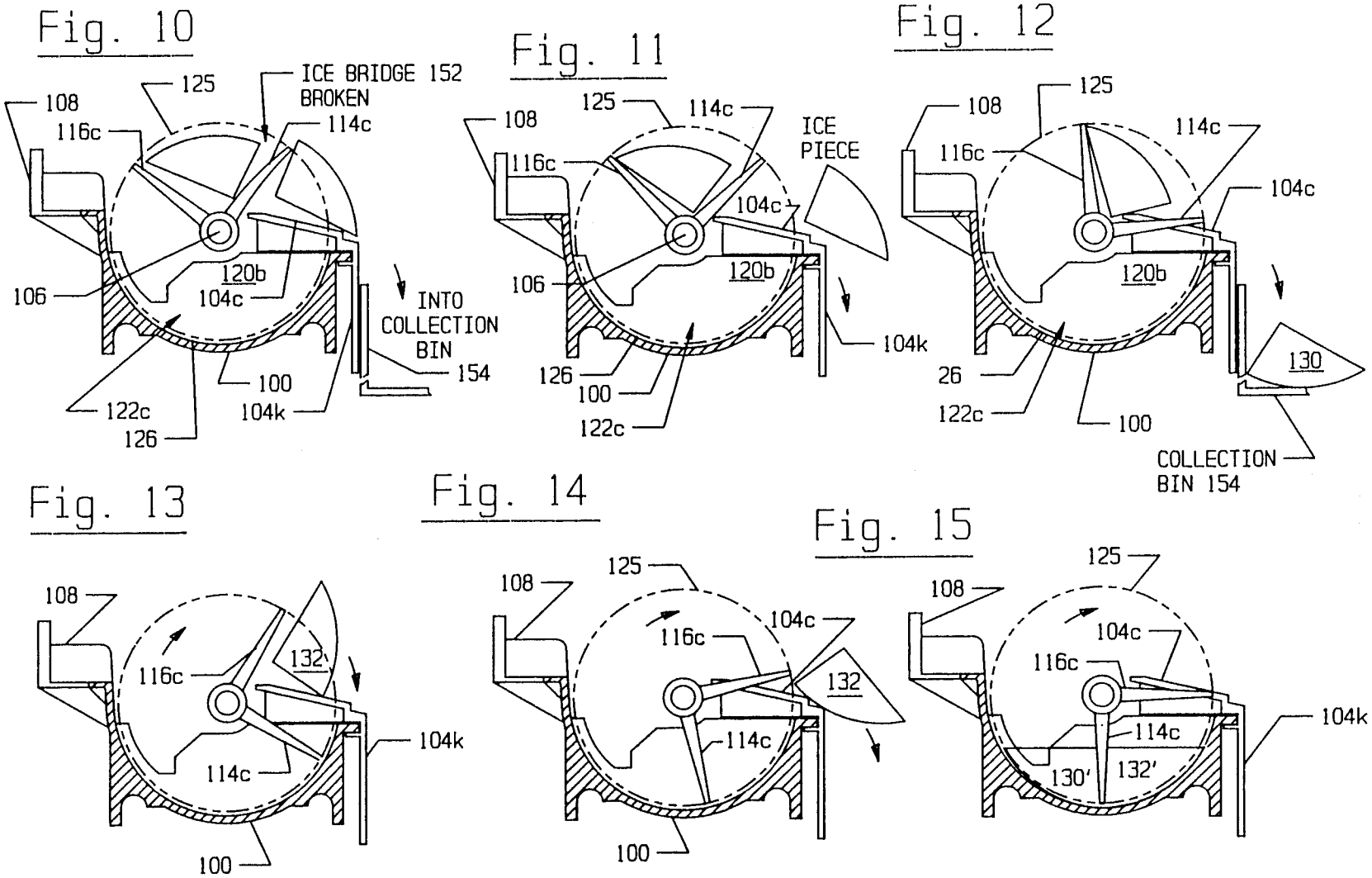

Referring now specifically to FIG. 1 an ice piece freezer tray (or mold) 100, shown separately in FIG. 2, has rotatably secured therein an ejector element assembly 102 (shown separately in FIG. 3) comprising a rotatable shaft 106 having two sets of ejector elements 114 and 116 (see FIG. 3) secured thereto separately and functionally to rotatably eject the two sets of half crescent ice pieces (see FIGS. 6–15) from the cavities 122 in the tray 100 in which they were formed, and an ice piece stripper assembly 104 (shown separately in FIG. 4) for stripping the two sets of half crescent shaped ice pieces from the ejector elements 114 and 116 of the ejector assembly 102, with the rotatably leading set of half crescent ice pieces 130 (see FIGS. 6–11) being stripped from the ejector elements 114 and 116 of the ejector assembly 102 by stripper assembly 104 and dumped into a collection bin (154 of FIG. 12) when the ejector assembly 102 has rotated the complete crescent shaped ice pieces about 220° from their original position of FIG. 6 when they were formed, and the lagging set of half crescent ice pieces 132 (see FIGS. 10–15) subsequently being stripped from the ejector assembly 102 and dumped into the collection bin (FIG. 12) when the ejector elements 114 and 116 of the ejector assembly 102 have rotated about the rotatable axis 106 about 345°, as shown in FIG. 14.

In the present invention the basic action of the flexible, spring-like primary ejector elements 114 are of basic importance and will now be described. In general the flexible, spring-like ejector elements 114, shown in FIGS. 3, 5–12, and in detail in FIGS. 3*a* and 3*b*, and which separate the leading and lagging rows of half crescent shaped ice pieces, will respond to the leading row of the half crescent shaped ice pieces being rotated by the rotatable shaft 106 to impact against the stripper elements 104 and thereby stop the rotation of the leading row of half crescent shaped ice pieces while the shaft 106 continues to rotate, thus causing the flexible, spring-like ejector elements 114 to flex back against the direction of rotation of the shaft 106 as shown in FIG. 9 and thereby accumulate a potential force therein.

The flexing back of the flexible, spring-like ejector elements 114 will create a dividing force between the leading and lagging rows of half crescent shaped ice pieces apart and break the ice bridge therebetween to allow the leading row of half crescent shaped ice pieces to be impelled forward out of the freezing tray by the flexible, spring-like leading ejector elements 114 as they snap back to their original positions and into a collection bin external of the tray.

The above generally described action is shown in more detail in FIGS. 9, 10, 11, and 12 which will be described later herein. In FIG. 8 a leading half cresent shaped ice piece 130 is shown shortly before impacting the stripper element 104*b*.

The two forms of the inventions shown and described herein, both rely on the potential energy stored in the thin, flexible, spring-like ejector elements 114 which are flexed back when the full cresent ice piece impacts the stripper elements 104 and then, when the ice bridges 152 between the leading and lagging half cresent ice pieces break, snap forward and impel the leading row 130 of half cresent ice pieces across the stripper elements 104 and over the edge of the freezer tray 100.

In one form of the invention employing the form of the flexible, spring-like ejector element shown in FIG. 3*a* the ice pieces of the lagging row 132 of cresent ice pieces are allowed to slide up or down on the flexible, spring-like element towards or away from the rotating shaft 106, as shown in FIGS. 6–15, after the ice bridge 152 between the leading and lagging rows of half cresent shaped ice pieces has been broken, as shown in FIGS. 10, 11, and 12, to be described in detail later herein.

In a second form of the invention, as shown in FIG. 3*b*, the flexible, spring-like element 114*b* has a small protuberance 121, which can be a short button or a rod-like structure, and which is secured to that surface of ejector element which faces the lagging half cresent shaped ice piece 132 and which is frozen therein at the beginning of an ice making cycle as shown and described with respect to FIGS. 16–23. The front surface of ejector element 114*b* can be smooth.

The purpose of the small protuberance 121 frozen into the lagging half cresent ice piece 132 is to prevent the lagging half cresent shaped ice piece 132 from falling or sliding downwardly on the flexible, spring-like ejector element 114 after the bonding ice bridge 152 between the leading and lagging rows 130 and 132 of half cresent shaped ice pieces have been broken apart by the flexing backwardly of the flexible, spring-like ejector elements 114 due to the impacting of the leading row of half cresent shaped ice pieces 130 upon the stripper elements 104. A more detailed discussion of this second form of the invention will be set forth later herein.

Referring again to FIG. 1, a set of brackets 108 and 110 are provided to secure the tray 100 of the half cresent shaped ice piece maker to a vertical side wall (not specifically shown) of the refrigerator or freezer. A control mechanism (shown in FIG. 28) is contained within a control mechanism housing 112 of FIG. 1, and functions generally to first rotate the shaft 106 (FIG. 3), containing the full cresent shaped ice pieces newly frozen on the flexible, spring-like ejector elements 114 (see FIG. 3), a full 360° and, as mentioned above, causing the leading row of half cresent shaped ice pieces 130 to be stripped from the flexible, spring-like rotating ejector element assembly 102 by the stripper assembly 104 when the shaft 106 has rotated about 220° (see FIGS. 8–11) and, with the lagging set of half cresent shaped ice pieces 132 being stripped from the rotating ejector element assembly 102 by stripper assembly 104 when the shaft 106 has rotated about 345° (see FIGS. 12–15).

Although not absolutely needed, the control mechanism within housing 112 (FIG. 1) can, if desired, then cause the shaft 106 to continue to rotate a full, second 360° to clear out any ice pieces which might accidentally remain in the mold (freezing tray) 100 and to permit other timing functions to be reset in order to prepare the system for the formation and ejection of the next leading and lagging rows of half cresent ice pieces.

The rotatable shaft 106 is supported at one end by a bearing (not shown) which is within the prime driver and control mechanism housing 112, and at the other end by a bearing (not shown) near the curved slot 123, also shown in FIG. 2, in a manner so that the axis of shaft 106 is coincident with the radical axis of the arcurately shaped freezer tray 100. The individual ejector elements of the two sets of ejector elements 114 and 116 are rigidly secured at one end to the rotatable shaft 106, as mentioned above, with each set of such ejector elements 114 and 116 extending along the entire length of the rotatable shaft 106, and further with each set of ejector elements 114 and 116 lying along separate common planes both of which are parallel to the axis of rotatable shaft 106.

The relative positions of the two sets of ejector elements 114 and 116, with respect to their initial position after water has been injected into tray 100 to level 118 (see FIG. 5) and then frozen into cresent shaped ice pieces, as such ejector elements 114 and 116 are rotated through increments of 360°, are shown representatively in the cross sectional view of a selected one of the cavities in FIGS. 6–15.

It is to be further specifically noted, as discussed briefly above, that each ejector element of the set of flexible, spring-like primary ejector elements 114 extends downwardly from the shaft 106 and into the center of one of the cresent shaped cavities 122 (see FIGS. 5 and 6) which is bounded by adjacent vertical separators or partitions 120 on either side thereof and by arcuately shaped (curved) inner surface of the freezer tray 100 on the edges thereof. The cavity 122 is filled to the predetermined level 118 with water (FIGS. 5 and 6) which, when frozen, will form a full crescent shaped ice piece but with the flexible, spring-like ejector element 114*b* frozen in the center thereof. Thus, each of the leading or primary flexible, spring-like ejector elements 114 divides each of such cavities 122 into two half crescent shaped cavities within which are formed two half crescent shaped ice pieces.

The second set of ejector elements 116 extend outwardly to the right from shaft 106 in FIG. 5 and are positioned over the water level 118. The angular distance from ejector elements 116 to the leading primary ejector elements 114, measured in a clockwise direction of rotation is about 75°-90°. The shaft 106, and therefore both sets of ejector elements 114 and 116, rotate in a clockwise direction, but only after the crescent shaped ice pieces have become frozen in their respective crescent shaped cavities 122.

It is apparent that, if desired, the set of ejector elements 114 can be designed to be positioned in their crescent shaped cavities at selected angular distances on either side of the position shown in FIG. 5 to divide the full full crescent shaped ice piece into two unequal portions of the initially crescent shaped ice piece. As the shaft 106 and the two sets of ejector elements 114 and 116 are rotated through 360° the rows of leading and lagging ice pieces 130 and 132 are broken apart by the impact of the leading half crescent ice piece with the stripper elements 104 and then dumped into an external collection bin 154 (shown in FIGS. 10 and 12) as two sets of different sized partial crescent shaped ice pieces, with each set of ice pieces being either slightly greater or slightly less in size than the half crescent ice pieces formed by the positioning of the ejector elements 114 as shown in FIG. 5.

The paths of the tips of the rotating sets of ejector elements 114 and 116 can, if desired, be coincident and are represented by the dashed line circle 125 in FIGS. 5-8, which sweeps close to, but does not contact, the circularly shaped bottom 126 of the generally arcuately shaped tray 100.

It is important to note that there is a bridge of ice 152 (see FIGS. 7, 8 and 9) connecting the two half crescent ice pieces 130 and 132 (of a single full crescent shaped ice piece) of FIGS. 5-15 in each of the cavities 122, and on either side of and at the tip of the ejector element 114*b*. It is this bridge of ice 152 around ejector elements 114*b* (see FIG. 5*a*) that connects to and helps pull the lagging half crescent shaped ice piece 132 along with the leading half crescent shaped ice pieces 130 as the leading half crescent shaped ice piece 130 is rotated by the flexible, spring-like primary ejector element 114*b* in a clockwise direction around the rotating shaft 106 which is being rotated by a suitable drive mechanism. The spacing between the edges of the flexible, spring-like ejector elements and the cavity separators also allows water to flow from the leading cavities to the lagging cavities to ensure a full crescent ice piece when the water freezes.

As mentioned above, the width c of the ejector elements, such as ejector element 114*c* (FIGS. 5*a*, 24, and 24*a*) is slightly less (typically 0.120") than the cavity 122*b*, in which the ejector element 114*c* is inserted. Therefore, the ice bridge 152 is formed around the sides and outer tip 150 (FIG. 6) of each ejector element 114*a*-114*h* which joins the rotatively lagging half crescent ice pieces 132 to the leading half crescent ice pieces 130 of the same full crescent ice pieces.

It is to be noted that the lagging row of ice pieces 132 also is frozen to the back side of the flexible, spring-like ejector element 114*b*.

To more fully understand the coaction between the rotating ejector elements 114 and 116 and the stripper assembly 104, which strips the notched, full crescent shaped ice pieces from the ejector elements 114 and 116, the relative dimensions of the width of the ejector elements 114, the distance "b" between adjacent stripper elements 104*b* and 104*c* of the stripper element assembly and the width of the crescent shaped ice pieces must be considered. Reference is now made more specifically to FIG. 5*a* which shows the relationship between the width of the ice pieces, the width "c" of the ejector elements 114*c*, and the distance "a" between adjacent separator stripper elements 120*b* and 120*c*.

In FIG. 5*a* adjacent separators 120*b* and 120*c* determine the width of the now ejected crescent shaped ice piece 130 which can be seen to be greater than the distance "b" between the adjacent stripper elements 104*b* and 104*c* by 0.120" (0.060" on each side of the ice piece 130), also shown in FIG. 24.

The width "c" of ejector element 114*c* is less than the width of ice piece 130 by 0.120" on each side of the ejector element 114. Thus, while the ejector element 114*c* will pass through adjacent stripper elements 104*b* and 104*c* in FIG. 5*a* by 0.060" on both sides of ejector element 114*b*, the ice piece 130 will be intercepted by the adjacent stripper elements 104*b* and 104*c* by 0.060" on both sides of the ice piece 130 to stop the rotation of ice piece 130 as shown in FIGS. 5*a* and 9. However, the ejector element 114*c* will continue to rotate to push the half crescent shaped ice piece 130 outwardly from the rotating shaft 106 to which the ejector element 114*c* is rigidly attached, as discussed above, and along the top surfaces of the adjacent stripper elements 104*b* and 104*c*, and ultimately outside the freezer tray cavity 122*b* and into a collection bin 154 (as shown in FIGS. 10-15).

A more detailed showing and discussion of the relationship between the ejector elements 114, the stripper fingers of stripper assembly 104, and the ejection of the ice pieces as the shaft 106 is rotated is shown in FIG. 24, which will be discussed later herein.

Referring again to FIG. 5 the top portion 134 of separator 120 preferably is at the same level as the short extension 134' thereof. Between the top levels 134 and 134' of separator 120 is a lowered portion 139 thereof. Ice bridges 140 are formed between adjacent leading half crescent shaped ice pieces 130 across the lowered portion 139 of separators 120 such as separator 120*c*. These ice bridges 140 join together all of the leading half crescent shaped ice pieces 130 into a solid row 130 of leading half crescent shaped ice pieces so that they, together with the ice bridges 152 of FIG. 5*a* and the freezing of the leading and lagging rows of half crescent ice pieces to the flexible, spring-like ejector elements 114 will join together the leading and lagging rows of half crescent ice pieces and will pull the lagging row 132 of half crescent shaped ice pieces along with the leading half crescent shaped ice pieces 130 as the leading half crescent shaped ice pieces 130 are rotated by the flexible, spring-like ejector elements 114.

While it is unlikely that any half crescent shaped ice pieces will break off from the full crescent shaped ice pieces 135 (FIGS. 8 and 9) prematurely and fall back into the tray 100, such an event could occur. In the event that a half crescent shaped ice piece accidently does fall back into the tray 100, the ice maker is so designed that the lagging row of ejector elements 116 will sweep any such stray ice pieces out of tray 100 and into the external collection bin 154 (FIGS. 10 and 12).

V. DESCRIPTION OF THE OPERATION OF THE BASIC FORM OF THE INVENTION (FIGS. 6–15

Referring now to FIGS. 6–15, there is shown the sequence of operation of ejecting the frozen crescent shaped ice pieces into an external collection bin 154 (FIGS. 8, 10 and 12) in the form of half crescent shaped ice pieces rather than full crescent shaped ice pieces. Before discussing FIGS. 6–15 it is to be noted that in FIGS. 6–15, the ejector elements 114*c* and 116*c* are shown in front of stripper element 104*b*.

Assume now that the full crescent shaped ice pieces are completely formed and that the tray 100 and separators 120 (FIG. 2) have been heated by a "u" shaped heater element 131 which extends along the bottom of the freezer tray 100 (see FIGS. 6 and 7) to release the full crescent shaped ice pieces from the tray 100 and the separators 120 so that rotation of the full crescent shaped ice pieces can now occur without being bonded (by freezing) to any part of ice tray 100.

As is apparent, FIGS. 6 through 15 are a form of schematic representation showing the interaction of only one cavity, one full crescent shaped ice piece, and one each of the ejector elements 114 and 116. FIGS. 16–23, which show an alternative form of the invention, also show the interaction of only one cavity, one full ice piece, and one each of the ejector elements 114 and 116.

The positions of the full crescent shaped ice pieces and the ejector elements 114*c* and 116*c* after about 35° of rotation are shown in FIG. 7. In FIGS. 8 and 9 the positions of ejector elements 114*c* and 116*c* are shown after rotating about 165° and 195°, respectively. In FIG. 8 the ice piece has retained its unified, full crescent shape while in FIG. 9, after a rotation of about 195° the leading half crescent ice piece 130 has just impacted the two adjacent stripper elements 104*b* (and 104*c*) and consequently has just broken away from the lagging half crescent ice piece 132 and is beginning to be pushed down the two adjacent stripper elements 104*b* and (104*c*) towards the edge of the tray 100 and ultimately over the edge of the tray 100 and into the collection bin 154 (see FIG. 12).

In FIG. 10 the ejector elements 114*c* and 116*c* are shown as having rotated about 215° with the ejector element 114*c* being in a position to be just at the point of pushing the leading half crescent ice piece 130 over the edge of the stripper assembly 104.

In FIGS. 11 and 12 the ejector elements 114*c* and 116*c* are shown after rotating from about 215° to about 265°, with the leading half crescent ice piece 130 having been completely pushed off the stripper element 104*c* and the lagging half crescent ice piece 132 being pushed onto and along the stripper element 104*b* towards the collection bin 154.

As shown in FIGS. 13, 14, and 15, after the ejector elements 114*c* and 116*c* have rotated about another 95° the lagging half crescent shaped ice piece 132 will have been pushed off the stripper elements 104*b* and 104*c* (FIG. 5*a*) and into the collection bin 154, and the ejector elements 114*c* and 116*c* will be in their initial positions, as shown in FIG. 15.

The cycle is not necessarily yet complete, however. If desired ejector elements 114*c* and 116*c* can be made to rotate another full 360° (optional) to finally come to rest in their initial position shown in FIGS. 5 and 6.

The optional second 360° rotation of ejector elements 114*c* and 116*c* (and shaft 106) can perform two functions. Firstly, the second 360° rotation of ejector elements 114*c* and 116*c* will clear the tray 100 of any stray half crescent shaped ice pieces that might have accidentally dropped into the tray 100 during the first 360° rotation of ejector elements 114*c* and 116*c* rather than having been properly stripped off the ejector elements 114*c* and 116*c* by stripper elements 104*b* and 104*c* (see FIG. 5*a*) and pushed into the external collection bin 154.

The time required to execute a second 360° rotation of ejector elements 114*b* and 116*b* also can be utilized, if desired, to reset the mechanism that initiates the beginning of the rotation of shaft 106, including the rows of ejector elements 114 and 116 attached thereto, to open a valve, to be discussed later herein, that permits the flow of water into inlet 129 of FIG. 2 to a predetermined level 118 in tray 100, to turn off the heater element 131 (to be discussed later in FIG. 28) which frees the frozen full crescent shaped ice pieces from the separators 120 (FIGS. 2, and 6–15) and the tray 100 under control of thermostat 129, thereby allowing rotation of the ice pieces 130 and 132 through the cycle shown in FIGS. 6–15 and described above. Turning off the heater element 131 will not only enable faster freezing of a new batch of ice pieces but will also conserve energy by allowing the freezer compartment to reach lower temperatures than would be obtainable if the heater element 131 were not deactivated when not needed.

As discussed above, only the leading row of half crescent shaped ice pieces 130 have an ice bridge (ice bridge 140 of FIG. 5) formed between adjacent ones of the (primary) leading row 130 of half crescent shaped ice pieces. The lagging row 132 of half crescent shaped ice piece (such as half crescent shaped ice piece 132) has no such corresponding ice bridges connecting adjacent lagging half crescent shaped ice pieces. The lagging row of half crescent shaped ice pieces 132 will easily break apart from each other as they fall into the collection bin 154 and form separate half crescent shaped ice pieces.

It might sometimes be desirable to form connected groups of two, three, or more half crescent shaped ice pieces as they are collected in the collection bin. The formation of groups of selected numbers of half crescent shaped ice pieces is easily accomplished by decreasing or increasing the size of the lowered portions 139 of selected ones of the separators 120. This will change the size of the ice bridge 140 between selected adjacent ones of the leading row of half crescent shaped ice pieces and thereby facilitate their breaking apart in different size groups of leading half crescent shaped ice pieces.

VI. DESCRIPTION OF THE OPERATION OF AN ALTERNATIVE FORM OF THE INVENTION

In a second form of the invention, as shown in FIG. 3*b*, the flexible, spring-like ejector element 114*c* has a small protuberance 121, which can be a short button or a rod-like structure secured to that surface of ejector element 114*c* which faces the lagging half crescent shaped ice piece 132 and which is frozen therein at the beginning of an ice making cycle as shown and described with respect to FIGS. 16–23. The front surface of ejector element 114 preferably is smooth.

The purpose of the small protuberance 121 frozen into the lagging half crescent ice piece 132 is to prevent the lagging half crescent shaped ice pieces 132 from falling, i.e. sliding downwardly on the flexible, spring-like ejector element 114 after the bonding ice bridge 152 between the leading and lagging rows 130 and 132 of half crescent shaped ice pieces has been broken by the flexing backward of the flexible, spring-like ejector elements 114 when the leading row of half crescent shaped ice pieces 130 impacts the stripper elements 104.

Figures 16, 17, 18, 19, 20, 21, 22, 23:
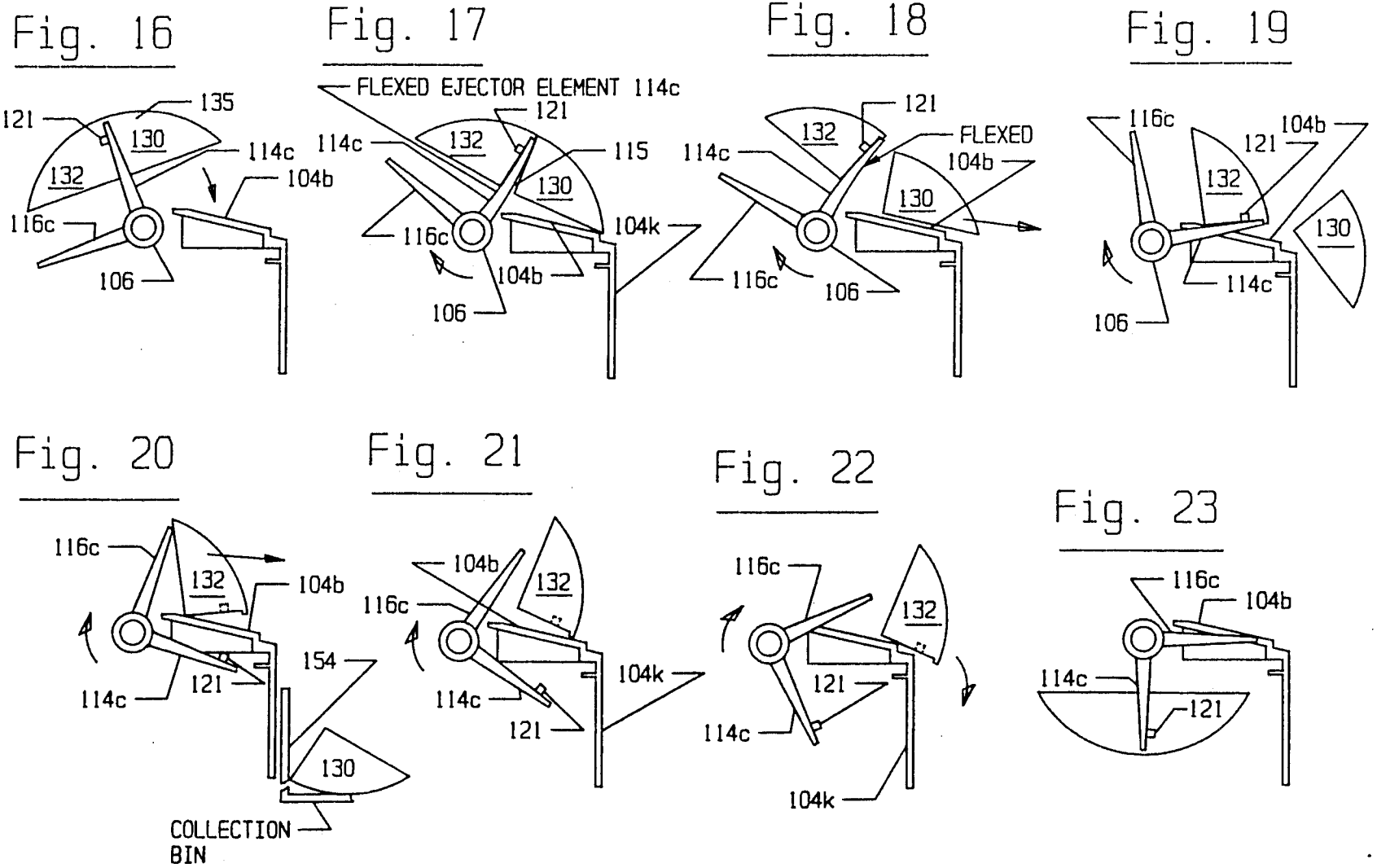

In FIGS. 16–23 only a portion of the full cycle of the second form of the invention is shown. FIG. 16 shows the ejector assembly and the full crescent ice piece 135 rotated about 160° with the full crescent ice piece 135 not yet having impacted the stripper element **104*b* (and 104*c*). Actually only stripper element 104*b* is shown in FIGS. 16–23**.

In FIG. 17 the ice piece is shown immediately after impacting the stripper element **104*c*. The resilient, spring-like element 114*c* has been bent back opposite the direction of shaft 106 rotation, breaking the resilient spring-like element 114*c* from both of the two half crescent ice pieces 130 and 132, and also breaking the ice bridge 152 between the leading and lagging half crescent ice pieces 130 and 132**.

However, the protuberance 121 remains embedded in the lagging half crescent ice piece 132 to restrain movement of the lagging half crescent ice piece 132 on the back surface of resilient, spring-like ejector element 115.

Immediately after the ice bonds between ice pieces 130 and 132 and spring-like ejector element **114*c* are broken the spring-like element 114*c* will spring forward, as shown in FIG. 17 and impel the half crescent ice piece 130 forward along the top of the stripper elements 104*b* (and 104*c*) towards the edge of the freezer tray 100**.

In FIGS. 19 and 20 the leading half crescent ice piece 130 is shown being pushed off the edge of freezer tray 100 via the stripper element **104*b* and into the collection bin 154. Also the lagging half crescent ice piece 132 is shown just before it impacts the stripper elements 104*b* (and 104*c*) in FIG. 19, and in FIG. 20 ice piece 132 is shown just after being stripped from the back side of resilient, spring-like element 114*b* and has pulled the protuberance 121 out of the lagging half crescent ice piece 132, thereby freeing the ice piece 132 to slide down stripper elements 104*b* (and 104*c***) and into the collection bin.

It can be seen in FIGS. 21 and 22 that as the lagging ejector element **116*b* continues to rotate it will push the lagging half crescent ice piece 132 along and off the stripper elements 104*b* (and 104*c*) and then over the edge of the freezer tray into collection bin 154. FIG. 23 shows the completion of the cycle and ejector elements 114*c* and 115*c* waiting for water to be injected into the freezer tray 100, frozen, and then rotated through the steps shown in FIGS. 16 through 23** to make a new batch of half crescent shaped ice pieces.

Referring now to prior art U.S. Pat. No. 3,362,181 issued Jan. 9, 1968 to Linstromberg there is shown in FIGS. 3, 4, 5, 7, 11 thereof a control mechanism including sensors, a motor, a motor drive means responsive to signals from the sensors to operate the required sequential operating steps of the present invention. More specifically the Linstromberg U.S. Pat. No. 3,362,181 shows and describes a motor drive arrangement, including a driving motor 204 in columns 8 and 9 thereof for providing the torque necessary to rotate the shaft 189 of FIG. 5 thereof and therefore also to rotate the ejector elements 188 of FIG. 4 thereof to eject the crescent shaped ice pieces formed in the freezing tray mold 126 (FIG. 1 of U.S. Pat. No. 3,362,181) in response to a signal generated by thermostat 254 of Linstromberg. The rotation of shaft 189 of Linstromberg also activates the control means for sequentially operating the various processing steps for the ice maker described therein, such as injection of water into the freezing ray, freezing the ice pieces, heating the freezing tray, and beginning and terminating the rotation of shaft 189.

The ejector assembly 131 of U.S. Pat. No. 3,362,181 is arranged to operate at a low torque permitting the use of plastic parts in the drive and ejector structure and providing improved safety of operation.

More specifically, the various sequences of operation of the Linstromberg U.S. Pat. No. 3,362,181 include injecting a measured and time controlled amount of water into the freezing mold 126 thereof described in columns 9, 10, and 11 of U.S. Pat. No. 3,362,181, freezing the water to a desired temperature as described in columns 5 and 6 thereof, heating the mold 126 to release the frozen full crescent shaped ice pieces therefrom to permit the full crescent shaped ice pieces to be pushed out of the freezing tray 126 by the rotating ejector elements described in columns 6 and 7 of Linstromberg, then stripping the ice pieces from the ejector elements 131 by the stripper 208 (FIG. 4) thereof, and finally dumping the ice pieces into an ice piece receiving bin 119 (see FIG. 1 of U.S. Pat. No. 3,362,181).

The control mechanisms shown in FIGS. 7 and 11 of Linstromberg are driven by motor 204, as mentioned above, to orchestrate the sequence of operational steps of Linstromberg's full crescent shaped ice piece maker and prepare the ice maker control means of FIGS. 7 and 11 of U.S. Pat. No. 3,362,181 for the freezing and ejection of the next batch of ice pieces.

The entire torque generating means (including the motor 204 of Linstromberg and the entire control structure for initiating and terminating all of the operational steps in the initiating and terminating all of the operational steps in the proper sequence and at the proper times), can be employed in the present invention, although only generally described herein. Accordingly, the entire driving and control structure of U.S. Pat. No. 3,362,181, as well as any other structure thereof required to drive the rotating shaft 106 of the present invention and to initiate and terminate all of the steps necessary to repeatedly form half crescent shaped ice pieces at the proper times and in the proper sequence, is hereby incorporated herein in the present specification by reference.

VI. DETAILED DISCUSSION OF RELATION OF CAVITY WIDTH, EJECTOR ELEMENTS WIDTH, AND WIDTH BETWEEN STRIPPER ELEMENTS REQUIRED TO EJECT HALF CRESCENT SHAPED ICE PIECES

In FIGS. 24–27 there are shown views of the leading row of ejector elements 114, the stripper assembly 104, the rotating shaft 106, their spatial relationship, and the shapes of the individual leading ejector elements 114, such as ejector element **114*b*, and the shape of the individual stripper elements, such as stripper elements 104*b* and 104*c* of the stripper assembly 104**.

Careful examination of FIG. 24 reveals that the width "c" of each of the flexible, spring-like ejector elements 114, such as flexible, spring-like ejector element **114*b* is slightly less (about 0.120") than the distance between adjacent stripper elements such as stripper elements 104*b* and 104*c* with about 0.060" clearance on both sides thereof. However, as will be described below, the ice pieces, whose width is greater by 0.120" than the distance between stripper elements 104***b* and 104*c*, is not able to pass between the adjacent stripper fingers 104*b* and 104*c* and will therefore be stripped from ejector element 114*b*. The foregoing will become will become clearer from the following text.

The distance X=0.060" in FIG. 24*a* represents the distance between the edge of a stripper element 104*b* and the edge of a flexible, spring-like ejector element 114*b*. The distance "y"=0.120" is the distance between the surface of the separator 120*b* and the edge of an ejector element 114*b*. It can be seen therefore in FIG. 24 that width of the ice piece formed between adjacent separators 120*b* and 120*c* is about 0.120" greater than the distance between the adjacent stripper fingers 104*b* and 104*c* and will therefore impact upon the adjacent stripper fingers 104*b* and 104*c* by about 0.060" on either side of the ice piece and accordingly will be stripped from the ejector elements 114*b* such as ejector element 114*b* of FIG. 24, and will be pushed into the collection bin 154 (FIGS. 10 and 12) by the continuing-to-rotate ejector element 114*b*.

FIG. 27 shows an end view of a stripper element 104*c*, and its supporting element 104*k*, which supports all of the stripper elements 104*a*–104*i*. Reference character 104*x* shows the underlying vertical support element thereof.

Referring now to FIG. 28 there is shown a diagram of the logic of the present invention which performs the necessary sequential steps of the operation of the ice maker through the cycle of operation required to make half crescent shaped ice pieces. It is to be understood that the structure of the above mentioned U.S. Pat. No. 3,362,181 provides a much more detailed showing and description of controls suitable to perform the sequential steps necessary to make the ice pieces, although one of ordinary skill in the art could construct suitable controls from the general diagram of FIG. 28 without departing from the spirit or scope of the present invention.

In FIG. 28 assume that a cycle of ice piece making has just been completed and the motor 300 has been turned off at the end of a second 360° revolution of shaft 106 by the output 308 of shaft 106 revolution counter 302, which will be reset to zero via lead 306 for the next cycle of operation. The water valve 316 will be opened via lead 312 to permit water to flow from water supply 318, through pipe 320, open water valve 316, pipe 322, and into the freezer tray 100.

When the water level in tray 100 reaches a level 118, the water level sensor 324 will supply a signal via leads 346 and 336 to close water valve 316 and to cause freezing of the water in tray 100 to begin.

Temperature sensor 326 detects when the water in tray 100 reaches a desired freezing temperature to freeze the ice pieces and will then supply a signal via leads 328 and 332 to enable heater 340 so that it can be heated by power from power source 309 via lead 333, thereby releasing the ice pieces from the tray 100, so that they can be ejected in the manner described in connection with FIGS. 5–23. The signal on lead 328 will also supply a signal to set timer 330 to zero from whence it will begin to time a new cycle period.

At the end of a predetermined period of time, timer 330 will supply a signal via lead 334 to energize the motor 300 to begin rotation of shaft 106 and thereby begin the ejection of the crescent shaped ice pieces from tray 100 as half crescent shaped ice pieces.

It is to be understood that the forms of the invention shown and described herein are but preferred embodiments thereof and that various modifications and other forms of the invention can be made by one of ordinary skill in the art without departing from the spirit or scope of the invention as defined in the appended claims.

I claim:

1. A method of making half crescent shaped ice pieces comprising the steps of:

injecting water into crescent shaped cavities of an elongated arcuately shaped tray having adjacent, spaced-apart separators positioned in planes normal to the radial axis of said arcuately shaped tray;

positioning a first rotatable shaft with its axis coincident with the radial axis of said arcuately shaped tray;

initially positioning a plurality of flexible, spring-like ejector elements, aligned in a common plane and secured to said rotatable shaft, individually into the center of each of said cavities to divide the crescent shaped volume of water contained therein into half crescent shaped volumes of water;

freezing the water in each of said cavities to produce a notched, full crescent shaped ice piece in each cavity with the notch being formed by the presence of said flexible, spring-like element therein to divide the full crescent shaped ice piece into rotatively leading and lagging half crescent shaped ice pieces;

rotating said shaft to rotate said notched, full crescent shaped ice pieces; and impeding the rotating, notched crescent shaped ice pieces by impact with a plurality of ice piece stripper elements positioned adjacent each side of each flexible spring-like ejector element to flex said flexible spring-like element backward with respect to the direction of rotation of said shaft to break apart the leading and lagging rows of half crescent shaped ice pieces and thereby enable the flexible, spring-like ejector elements to spring forward to impel the leading row of half crescent ice pieces forward onto and over said stripper elements and out of the tray into an external collection bin; and ejecting said lagging row of half crescent ice pieces into said collection bin as said shaft continues to rotate.

2. A method as in claim 1 and further comprising the steps of: forming a protuberance on that surface of each of said flexible, spring-like elements facing a lagging half crescent shaped ice piece;

freezing said protuberances within the surfaces of said lagging half crescent shaped ice pieces when said lagging crescent shaped ice pieces are frozen;

rotating said full crescent shaped ice pieces until the leading row of half crescent shaped ice pieces impact said stripper elements and break loose from said lagging row of half crescent shaped ice pieces;

preventing said lagging half crescent shaped ice pieces from moving away from the point where said protuberance is frozen into the surface of the lagging half crescent shaped ice piece;

breaking loose said lagging half crescent shaped ice pieces from said protuberances when said leading flexible, spring-like ejector elements pass between adjacent stripper elements; and ejecting said broken-loose lagging half crescent shaped ice pieces from said tray.

3. An ice piece maker for cyclically making batches of half crescent ice pieces and comprising:

an arcuately shaped tray comprising a plurality of crescent shaped cavities lying side-by-side and formed by separators each normal to the radial axis of said tray;

a rotatable shaft assembly comprising:

mounting bearings positioned at both ends thereof in fixed position with respect to said tray to position said shaft with its axis coincident with said radial axis of said tray; and a plurality of flexible, spring-like ejector elements secured side-by-side in an aligned row along said shaft and positioned to extend individually into said crescent shaped cavities to divide each of said crescent shaped cavities into rotatable, leading and lagging half crescent shaped cavities before said shaft assembly begins its rotation in any given cycle of operation;

means for filling the crescent shaped cavities with water and then freezing the water before beginning rotation of said shaft to form leading and lagging rows of half crescent shaped ice pieces;

a row of stripper elements lying in the path of said leading row of half crescent shaped ice pieces; and means responsive to the freezing of said water to rotate said shaft, said flexible, spring-like ejector elements, and said full crescent shaped ice pieces until said leading row of half crescent shaped ice pieces impacts against said stripper elements to force said flexible, spring-like ejector elements and said leading row of half crescent shaped ice pieces back against the direction of rotation of said rotatable shaft and upwardly on said flexible, spring-like ejector elements and away from said rotatable shaft until said leading and lagging rows of half crescent ice pieces break apart and the spring tensioned flexible, spring-like ejector elements are released to cause said flexible, spring-like ejector elements to spring forward to impel the leading half crescent ice pieces over the stripper elements and outside of said tray.

4. An ice piece maker in accordance with claim 3 in which each of said flexible, spring-like ejector elements comprises a protuberance on the side thereof facing a lagging half crescent shaped ice piece and which protrudes into the lagging half crescent shaped ice piece to prevent said lagging half crescent shaped ice piece from sliding upwardly when said row of leading half crescent shaped ice pieces is moved upwardly on said leading row of flexible, spring-like ejector elements upon impact with said stripper elements, and further which prevents the sliding of said lagging half crescent shaped ice pieces down said flexible, spring-like ejector element after said leading row of ejector elements has been broken loose from said lagging row of ejector elements after impact with said stripper elements.

5. A method of cyclically making batches of partial crescent shaped ice pieces comprising the steps of:

injecting water in a plurality of crescent shaped cavities of an elongated arcuately shaped tray formed by spaced apart separators positioned normal to the radial axis of said arcuately shaped tray;

positioning a shaft having a row of flexible, spring-like elements secured side-by-side at a first end thereof on said shaft in a row along a line parallel to said shaft axis, and with said shaft axis coincident with said radial axis of said tray and further with the shaft ends rotatably supported in bearings secured in a fixed position with respect to said tray;

controllably rotating said shaft around its axis coincident with said radial axis of said tray;

extending each of the second ends of said flexible, spring-like ejector elements individually into one of said crescent shaped cavities before said crescent shaped ice pieces are formed to divide said crescent shaped cavity into leading and lagging partial crescent shaped cavities with respect to the rotation of said shaft during a cycle of the ice piece making operation;

injecting water into said cavities;

freezing said water with said flexible, spring-like ejector elements extending therein;

rotating said shaft, said flexible, spring-like elements, and said crescent shaped ice pieces until the leading row of partial crescent shaped ice pieces impacts a stripper assembly which impedes further rotation of said leading row of partial ice pieces and forces said flexible, spring-like ejector elements to bend in a direction opposite the direction of rotation of said shaft;

breaking the ice bond between said leading and lagging rows of partial crescent ice pieces to enable the force built up in said bent-back flexible, spring-like ejector elements to impel the leading row of partial crescent ice pieces out of said tray; and ejecting the lagging row of half crescent shaped ice pieces out of said tray as said shaft continues to rotate.

6. A method as in claim 5 and further comprising the steps of:

forming a protuberance on that surface of each of said flexible, spring-like elements facing a lagging half crescent shaped ice piece;

freezing said protuberances in the surfaces of said lagging half crescent shaped ice pieces when said lagging half crescent shaped ice pieces are frozen;

rotating said full crescent shaped ice pieces until the leading row of half crescent shaped ice pieces impact the stripper elements and break loose from said lagging row of half crescent shaped ice pieces;

preventing said lagging half crescent shaped ice pieces from moving by means of said protuberance being frozen into the surface of the lagging half crescent shaped ice piece;

breaking loose said lagging half crescent shaped ice pieces from said protuberances when said leading ejector elements pass between adjacent ejector elements; and ejecting said broken-loose lagging half crescent shaped ice pieces from said tray.

7. In an assembly comprising an arcuately shaped elongated tray divided into full crescent shaped cavities by a series of spaced apart separators positioned normal to the radial axis of said arcuately shaped tray and a shaft rotatably supported at both ends by bearings with the axis of said shaft being coincident with the radial axis of said arcuately shaped tray, and with said shaft having a row of flexible, spring-like elements secured thereto, lying in a common plane, and extending outwardly from said shaft individually into each of said crescent shaped cavities at the beginning of each cycle of operation to divide said crescent shaped cavities into two half crescent shaped cavities, a method for making half crescent shaped ice pieces comprising the steps of:

injecting water into said cavities;

freezing said water with said flexible, spring-like ejector elements extending into said cavities to form rotatively leading and lagging half crescent shaped ice pieces with ice bridges being formed around the edges of said flexible, spring-like ejector elements to connect together the leading and lagging half crescent ice pieces;

rotating said shaft and thereby rotating said flexible spring-like ejector elements and said crescent shaped ice pieces; and impeding the rotation of the leading row of half crescent shaped ice pieces to bend said flexible, spring-like elements back against the lagging row of half crescent ice pieces to break the ice bridge between the leading and lagging rows of half crescent ice pieces and enable the bent-back ejector elements to spring forward and eject the leading row of half crescent shaped ice pieces out of said tray.

8. A method as in claim 7 and further comprising the steps of:

forming a protuberance on that surface of each of said flexible, spring-like elements facing a lagging half crescent shaped ice piece;

freezing said protuberances in the surfaces of said lagging half crescent shaped ice pieces when said lagging crescent shaped ice pieces are frozen;

rotating said full crescent shaped ice pieces until the leading row of half crescent shaped ice pieces impact ice piece stripper elements and break loose from said lagging row of half crescent shaped ice pieces;

preventing said lagging half crescent shaped ice pieces from moving away from the juncture of said protuberance and the point where said protuberances are frozen into the surface of the lagging half crescent shaped ice pieces;

breaking loose said lagging half crescent shaped ice pieces from said protuberances when said leading flexible, spring-like ejector elements pass between adjacent ejector elements; and ejecting said broken-loose lagging half crescent shaped ice pieces from said tray.

9. In an ice piece maker comprising an arcuately shaped freezing tray divided into crescent shaped cavities and a set of flexible, spring-like ejector elements mounted in a row upon a rotatable shaft secured at both ends in bearings positioned to enable each of said flexible, spring-like ejector elements to sweep through one of said cavities each revolution of said shaft, a method of forming half crescent shaped ice pieces comprising the steps of:

positioning said shaft so that said flexible, spring-like ejector elements extend into said cavities to divide said cavities into rotatively leading and lagging partial crescent shaped cavities when said shaft rotates;

filling said cavities with water;

freezing said water to form rotatively leading and lagging partial crescent shaped ice pieces with an ice bridge therebetween;

rotating said shaft along with said ejector flexible, spring-like elements and said partial crescent shaped ice piece;

impeding the leading row of partial crescent shaped ice pieces to cause said leading row of half crescent shaped ice pieces to stop rotating and move outwardly away from said ejector elements, thereby bending back the flexible, spring-like ejector elements to create a potential force therein;

breaking the ice bridge between said leading and lagging rows of partial crescent shaped ice pieces to release the potential force in said bent-back flexible, spring-like ejector elements to cause said flexible, spring-like ejector elements to spring forward to their original positions and quickly eject said leading row of partial crescent shaped ice pieces out of said freezing tray; and continuing to rotate said shaft and said lagging row of partial crescent shaped ice pieces with a second row of ejector elements to move said lagging row of partial crescent pieces out of said tray.

10. A method as in claim 9 and further comprising the steps of:

forming a protuberance on that surface of each of said flexible, spring-like elements facing a lagging half crescent shaped ice piece;

freezing said protuberances in the surfaces of said lagging half crescent shaped ice pieces when said lagging crescent shaped ice pieces are frozen;

rotating said full crescent shaped ice pieces until the leading row of half crescent shaped ice pieces impact stripper elements and break loose from said lagging row of half crescent shaped ice pieces;

preventing said lagging half crescent shaped ice pieces from moving away from the juncture of said protuberance and the point where said protuberance is frozen into the surface of the lagging half crescent shaped ice piece;

breaking loose said lagging half crescent shaped ice pieces from said protuberance when said leading flexible, spring-like ejector elements pass between adjacent ejector elements; and ejecting said broken-loose lagging half crescent shaped ice pieces from said tray by the continued rotation of a second row of ejector elements which follow said row of flexible, spring-like elements.

11. A cyclical ice piece maker comprising:

an arcuately shaped elongated freezing tray divided into water fillable crescent shaped cavities by separators positioned normal to the radial axis of said tray which are filled with water at the beginning of a cycle of making ice pieces and with a shaft secured in bearings and controllably rotatable about an axis coincident with said radial axis in response to the freezing of ice pieces in said cavities and comprising:

a first row of flexible, spring-like ejector elements positioned in a common plane and attached securely at a first end to said shaft and with said second end thereof extending into one of said cavities when said shaft is in its controlled, non-rotating position at the start of a cycle before the injection and freezing of water into said cavities has occurred;

first means for injecting water into said cavities with said flexible, spring-like ejector elements extending into said cavities to divide said cavities into leading and lagging rows of water filled half crescent shaped cavities;

second means for freezing said water in said cavities to form leading and lagging rows of rotatable half crescent shaped ice pieces with the leading and lagging half crescent shaped ice piece of each full crescent shaped ice piece being connected together by an ice bridge formed around the inserted flexible, spring-like ejector element;

stripper means positioned over said tray in the paths of said half crescent ice pieces when they are rotated by said shaft;

third means responsive to said second means to initiate rotation of said shaft, said flexible, spring-like ejector elements, and said crescent shaped ice pieces until said leading row of half crescent shaped ice pieces impacts against said stripper means to bend said flexible, spring-like elements backwards against the direction of rotation of said shaft to build up a potential force in said flexible spring-like ejector elements and to break the ice bond between said leading and lagging rows of half crescent shaped ice pieces, thereby enabling said flexible, spring-like ejector elements to spring forward and impel the leading row of half crescent shaped ice pieces out of said tray; and means responsive to the continued rotation of said shaft to eject the lagging row of half crescent shaped ice pieces from said freezing tray.

12. An ice piece maker in accordance with claim 11 in which each of said flexible, spring-like ejector elements comprise a protuberance on the side thereof facing a lagging half crescent shaped ice piece to prevent said lagging half crescent shaped ice piece from sliding outwardly when said leading row of half crescent shaped ice pieces is moved outwardly on said flexible, spring-like ejector elements upon impact with said stripper means, and further which prevents the lagging row of half crescent shaped ice pieces from sliding down said flexible, spring-like ejector elements after said leading row of half crescent shaped ice pieces has been broken loose from said lagging row of half crescent shaped ice pieces upon impact with said stripper means.

* * * * *